US008919432B1

(12) United States Patent
Tetzlaff et al.

(10) Patent No.: US 8,919,432 B1
(45) Date of Patent: Dec. 30, 2014

(54) APPARATUS, SYSTEM AND METHOD FOR REDUCING GAS INTAKE IN HORIZONTAL SUBMERSIBLE PUMP ASSEMBLIES

(71) Applicant: Summit ESP, LLC, Tulsa, OK (US)

(72) Inventors: Steven Keith Tetzlaff, Owasso, OK (US); Lance Travis Robinson, Tulsa, OK (US); Wesley John Nowitzki, Broken Arrow, OK (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/303,116

(22) Filed: Jun. 12, 2014

Related U.S. Application Data

(60) Provisional application No. 61/834,734, filed on Jun. 13, 2013.

(51) Int. Cl.
*F04D 25/06* (2006.01)

(52) U.S. Cl.
CPC ..... *F04D 25/0686* (2013.01)
USPC ..... 166/105.5; 166/329; 166/68

(58) Field of Classification Search
USPC ..... 166/68, 105, 105.5, 242.6, 242.3, 329, 166/328; 417/423.3
See application file for complete search history.

(56) References Cited

U.S. PATENT DOCUMENTS 4,330,306 A * 5/1982 Salant ..... 96/219
4,481,020 A 11/1984 Lee et al.
47,011 A * 3/1985 Greenleaf ..... 166/105.5
5,207,810 A 5/1993 Sheth
5,588,486 A * 12/1996 Heinrichs ..... 166/50
5,653,286 A 8/1997 McCoy et al.
6,547,514 B2 4/2003 Lee
6,676,366 B2 1/2004 Kao
6,715,556 B2 * 4/2004 Mack et al. ..... 166/369
6,723,158 B2 * 4/2004 Brown et al. ..... 96/214
6,755,250 B2 * 6/2004 Hall et al. ..... 166/265
7,270,178 B2 * 9/2007 Selph ..... 166/105.5
7,766,081 B2 8/2010 Brown et al.
7,921,908 B2 * 4/2011 Tetzlaff et al. ..... 166/108
7,980,314 B2 * 7/2011 Mack ..... 166/369

(Continued)

OTHER PUBLICATIONS

Baker Hughes Incorporated, "ESP Gas-Avoiding Intakes," Product Brochure, 2012, 1 page.

(Continued)

*Primary Examiner* — Nicole Coy
(74) *Attorney, Agent, or Firm* — Frederic Dorwart, Lawyers; Penina Michlin Chiu

(57) ABSTRACT

An apparatus, system and method for reducing gas intake in horizontal submersible pump assemblies are described. A horizontal electric submersible pump (ESP) system for pumping gaseous fluid comprises a multi-stage centrifugal pump, an electric motor operatively coupled to the centrifugal pump, and an intake section upstream of the pump comprising a tapered core further comprising a sloped outer surface extending between a downstream side and an upstream side, a first intake port for the intake of well fluid in an ESP assembly, the first intake port located on a top portion of the tapered core and proximate to the downstream side, a gravity-actuated closing member moveably attached on the sloped outer surface, wherein the gravity-actuated closing member closes the first intake port, and a second intake port located on a bottom portion of the tapered core, the second intake port open to the well fluid.

19 Claims, 8 Drawing Sheets

(56) References Cited

U.S. PATENT DOCUMENTS

| | | | | |
|---|---|---|---|---|
| 8,012,243 | B2 * | 9/2011 | Saville | 95/267 |
| 8,016,571 | B2 | 9/2011 | Speer et al. | |
| 8,070,426 | B2 | 12/2011 | Brunner et al. | |
| 8,747,078 | B2 * | 6/2014 | Brown et al. | 417/313 |
| 2014/0030055 | A1 | 1/2014 | Jayaram et al. | |

OTHER PUBLICATIONS

Schlumberger, "ESP Technologies for Operating in High-Gas Environments," Product Brochure, taken from http://www.s1b.com/~/media/Files/artificial_lift/other/gassolution.pdf, Apr. 26, 2009, 8 pages.

* cited by examiner

APPARATUS, SYSTEM AND METHOD FOR REDUCING GAS INTAKE IN HORIZONTAL SUBMERSIBLE PUMP ASSEMBLIES

CROSS REFERENCE TO RELATED APPLICATIONS

This application claims the benefit of U.S. Provisional Application No. 61/834,734 to Tetzlaff et al., filed Jun. 13, 2013 and entitled "APPARATUS, SYSTEM AND METHOD FOR AVOIDING GAS INTAKE IN HORIZONTAL SUBMERSIBLE PUMP ASSEMBLIES," which is hereby incorporated by reference in its entirety.

BACKGROUND OF THE INVENTION

1. Field of the Invention

Embodiments of the invention described herein pertain to the field of electric submersible pumps. More particularly, but not by way of limitation, one or more embodiments of the invention enable an apparatus, system and method for reducing gas intake in horizontal submersible pump assemblies.

2. Description of the Related Art

Fluid, such as oil or water, is often located in underground formations. In such situations, the fluid must be pumped to the surface so that it can be collected, separated, refined, distributed and/or sold. Conventionally, electric submersible pumps (ESPs) have been used to pump fluid from subsurface well bores. In an ESP assembly, well fluid enters the assembly through an intake section and is lifted to the surface by a multistage centrifugal pump. Centrifugal pumps impart energy to a fluid by conferring angular momentum to the fluid passing through the pump. The angular momentum converts kinetic energy into pressure, thereby raising the pressure on the fluid and lifting it to the surface.

FIG. 1 and FIG. 2 illustrate conventional intake sections of an ESP assembly of the prior art. FIG. 1 is a bolt-on intake of the prior art. FIG. 2 is an integral intake section of the prior art. As shown in FIGS. 1 and 2, intake sections are typically cylindrical in shape and allow for entrance of well fluid into the bottom of the centrifugal pump through intake ports. Slotted or perforated screens are sometimes placed around the outside of the intake to filter solids from the well fluid and/or to attempt to separate gas from the well fluid in reverse-flow designs. Intake sections are typically located between the pump and seal section in an ESP assembly. Rotatable shafts extend through the center of the ESP assembly, passing through the pump, intake section, seal section and electric motor. The shafts of the assembly components are connected in series; the motor turns the shafts, providing power to the pump.

In some instances, it is desirable to place an ESP horizontally in a well bore. Horizontal well bores including horizontally arranged ESP assemblies allow an increased amount of well fluid to be exposed to the pump assembly, which allows for increased fluid production as compared to vertical assemblies. Unfortunately, well fluid sometimes contains gas in addition to liquid. Conventional ESP assemblies are designed to handle fluid consisting mainly of liquid. When pumping gas-laden fluid, the gas and liquid may separate due to a lack of downhole pressure or low production inlet pressure. This is particularly true in horizontal wells, where well liquid may sometimes falls to the bottom part of the horizontal well, while gas builds up across the upper part of the well because of the difference in specific gravity between the gas and liquid.

A conventional horizontal ESP assembly is illustrated in FIG. 3. Conventional ESP assembly 100 includes ESP motor 130, ESP seal section 135, conventional ESP intake 140 and ESP centrifugal pump 145. Production tubing 150 carries produced well fluid to the surface. As shown in FIG. 3, conventional ESP assembly 100 is oriented horizontally in underground well 105, within casing 110. Perforations 115 allow well fluid to enter casing 110. During operation of ESP assembly 100, gas layer 120 forms on upper portion of assembly 100, and liquid layer 125 forms on the lower portion, due to the lack of downhole pressure and difference in specific gravity between gas and liquid in the well fluid. This separation of gas and liquid causes gas pockets that interfere with the fluid flow necessary for the pump to operate properly. If the amount of gas taken into the pump reaches typically around 10% to 15% by volume, the pump may experience a decrease in efficiency and decrease in capacity or head (slipping). If gas continues to accumulate on the suction side of the pump it may entirely block the passage of fluid through the pump. When this occurs the pump is said to be "gas locked" since proper operation of the pump is impeded by the accumulation of gas. Gas locking causes damage to the pump and a loss of production. In some instances even small amounts of gas in well fluid may cause an emulsion which is difficult for ESPs to handle. As a result, careful attention to gas management in submersible pump applications is needed in order to pump gas laden fluid from subsurface formations.

Conventionally gas separators have sometimes been used in an attempt to address the problems caused by gas-laden fluid in ESP applications. Gas separators attempt to remove gas from produced fluid prior to the fluid's entry into the pump. However it is often infeasible, costly or too time consuming to determine the correct type of pump and separator combination that might be effective for a particular well. Even if the correct arrangement is determined, the separator may not remove enough gas to prevent a loss in efficiency or gas locking. Alternatively, reverse-flow intakes have also been used to cause natural separation of gas prior to intake, but reverse-flow intakes are not effective in horizontal well applications. It would be an advantage in horizontal well applications if intake ports at the top of the intake section, where gas accumulates, could be closed to reduce gas intake, while the intake ports at the bottom, where the liquid accumulates, would remain open. In practice this concept has proven difficult to implement since during installation of a conventional ESP assembly, the assembly rotates about its longitudinal axis. As a result, the final radial orientation of the ESP assembly within the well is unknown prior to installation, and identifying which intake ports should be open and which intake ports should be closed has thus proven difficult.

In the case of an electric submersible pump (ESP), a failure of the pump or any support components in the pump assembly can be catastrophic as it means a costly delay in well production and having to remove the pump from the well for repairs. A submersible pump system capable of reducing gas intake would be an advantage in all types of submersible assemblies. Therefore, there is a need for an apparatus, system and method for reducing gas intake in horizontal electric submersible pump assemblies.

BRIEF SUMMARY OF THE INVENTION

One or more embodiments of the invention enable an apparatus, system and method for reducing gas intake in horizontal submersible pump assemblies.

An apparatus, system and method for reducing gas intake in horizontal submersible pump assemblies are described. An illustrative embodiment of an intake section of an electric submersible pump (ESP) assembly, the ESP assembly comprising a centrifugal pump and an electric motor, the ESP assembly arranged about horizontally in a well comprising gas laden fluid, comprises a tapered cylindrical core, wherein a slope of the tapered core extending from an upstream side to a downstream side is downward at a top portion and upward at a bottom portion, at least two tracks circumferentially dispersed about the tapered core, wherein the at least two tracks extend lengthwise between the upstream side and the downstream side of the tapered core, and wherein the downstream side of each of the at least two tracks comprises an intake port, wherein the intake ports are fluidly coupled to a centrifugal pump, and a closing member moveably attached within each of the at least two tracks such that a particular intake port located on the top portion of the tapered core is blocked by the moveable closing member, and a particular intake port located on the bottom portion of the tapered core is open. In some embodiments, the intake section comprises a first and a second tapered core arranged in series, wherein the first and the second tapered cores each comprise five tracks evenly and circumferentially dispersed about the tapered core, and wherein the tracks of the first tapered core are offset radially by 36 degrees from the tracks of the second tapered core. In some embodiments, the closing member is two tungsten carbide ball bearings. In some embodiments, the intake section is located upstream of an electric motor of an ESP assembly. In certain embodiments, the intake section is located between an ESP seal section and an ESP pump.

A horizontal electric submersible pump (ESP) for pumping gaseous fluid of an illustrative embodiment comprises a multi-stage centrifugal pump, an electric motor operatively coupled to the centrifugal pump, and an intake section upstream of the centrifugal pump, the intake section comprising a tapered core further comprising a sloped outer surface extending between a downstream side and an upstream side of the tapered core, a first intake port for the intake of well fluid in an ESP assembly, the first intake port located on a top portion of the tapered core and proximate to the downstream side, a gravity-actuated closing member moveably attached on the sloped outer surface, wherein the gravity-actuated closing member closes the first intake port, and a second intake port located on a bottom portion of the tapered core, the second intake port open to the well fluid. In some embodiments, each intake port further comprises a track extending along the sloped outer surface and terminating proximate to the intake port. In certain embodiments, the closing member is two tungsten carbide ball bearings each 1.125 inches in diameter.

An illustrative embodiment of a fluid intake system for an electric submersible pump (ESP) assembly submersed in a downhole well, the downhole well comprising gas and liquid, the fluid intake system comprises a centrifugal pump, an intake section fluidly coupled to the centrifugal pump, the intake section comprising, a tapered cylindrical core, an intake port on a sloped surface of the tapered cylindrical core, and a gravity-actuated closing member moveably attached on the sloped surface, wherein when the centrifugal pump is arranged about horizontally in a well, the intake port is located on a top portion of the sloped surface and closed by the gravity-actuated closing member, and wherein when the centrifugal pump is arranged vertically in a well, the intake port is open. In some embodiments, the intake port further comprises a valve, wherein the valve closes the intake port when triggered by the gravity-actuated closing member, and wherein the gravity-actuated closing member comprises a mercury switch. In certain embodiments, the intake port further comprises a valve, wherein the valve closes the intake port when signaled by a variable speed drive.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
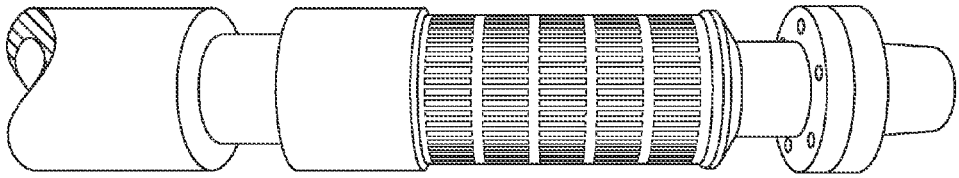
FIG. 1 PRIOR ART
FIG. 1 is a perspective view of a conventional bolt-on intake section of an ESP assembly of the prior art.
Figure 2:
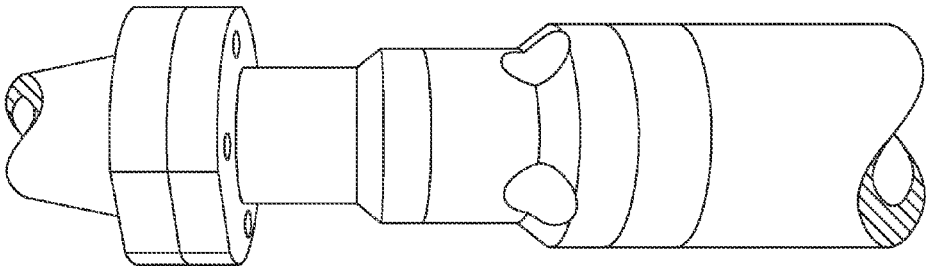
FIG. 2 PRIOR ART
FIG. 2 is a perspective view of a conventional integral intake section of an ESP assembly of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for reducing gas intake in horizontal submersible pump assemblies are described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a closing member includes one or more closing members.

"Coupled" refers to either a direct connection or an indirect connection (e.g., at least one intervening connection) between one or more objects or components. The phrase "directly attached" means a direct connection between objects or components.

"Above," "top or "upper" refers to the direction substantially towards the surface of the Earth. "Below," "bottom" or "lower" refers to the direction substantially opposite the surface of the Earth.

"Downstream" refers to the direction substantially with the flow of pumped fluid when the ESP assembly is in operation.

"Upstream" refers to the direction substantially opposite the flow of pumped fluid when the ESP assembly is in operation.

As used in this specification and the appended claims, "downward", with respect to a slope or taper of a core of an intake section arranged about horizontally in a well, means a negative slope as measured from an upstream side to a downstream side of the core. "Upward" with respect to a slope or taper of a core of an intake section arranged about horizontally in a well, means a positive slope as measured from an upstream side to a downstream side of the core.

"Horizontal" or "Horizontally" refers to an orientation parallel to the horizon of the Earth, or approximately parallel to the surface of the Earth as viewed in cross section. As used herein, the surface of the Earth above a downhole well may be approximated as "horizontal." "About horizontal" or "about horizontally" refers to an orientation less than or equal to a 15 degree deviation from horizontal in any direction.

"Vertical" or "Vertically" refers to an orientation approximately perpendicular to the surface of the Earth.

Figure 4:
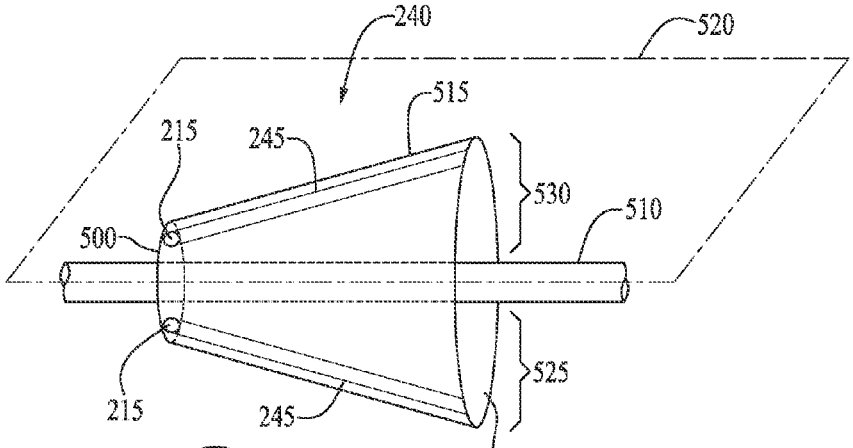
FIG. 4 is a diagram of a tapered cylindrical core of an illustrative embodiment oriented about horizontally in a downhole well.
Figure 3:
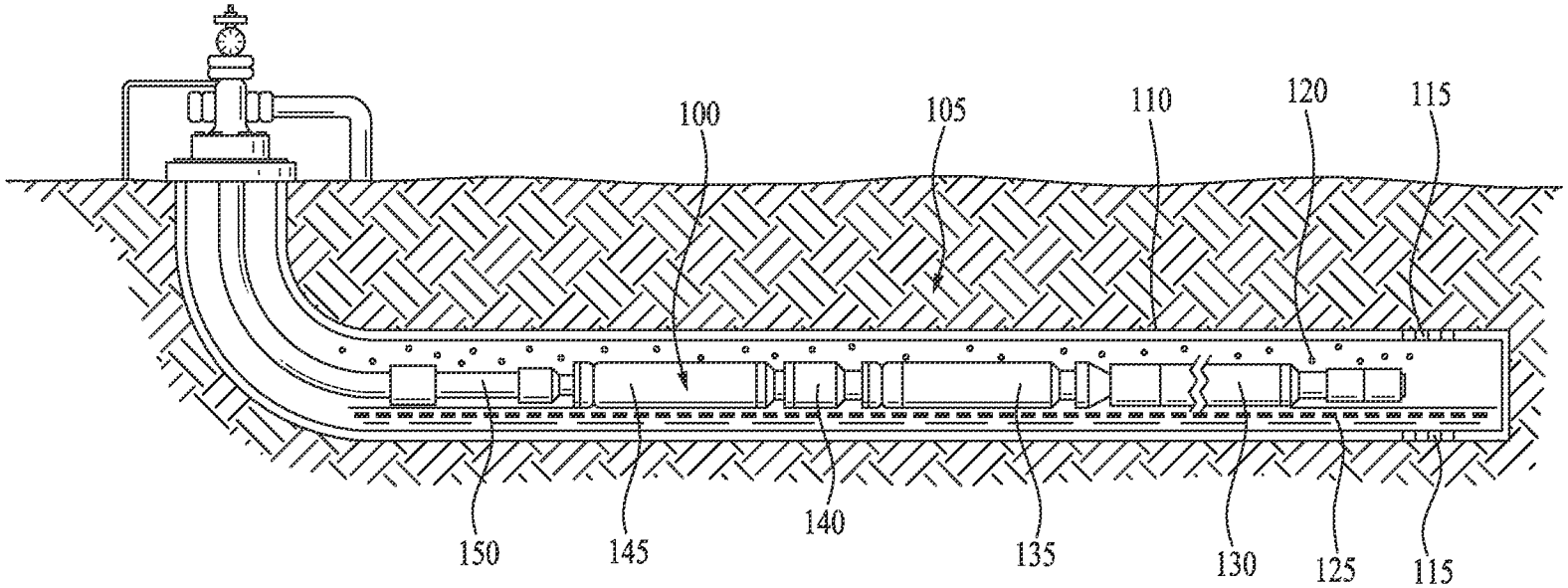
FIG. 3 PRIOR ART
FIG. 3 is a schematic cross section of an ESP assembly of the prior art installed in a horizontal well containing gas-laden fluid.

With respect to an ESP assembly arranged about horizontally in a well, the "top portion" and "bottom portion" of the intake section and/or core of the ESP assembly means as follows:

Take a horizontal plane (parallel to the surface of the Earth) extending lengthwise through the center of volume of the core of the intake section. Slicing the intake section at such location, the "top portion" of the intake section is the portion above the horizontal plane, and the "bottom portion" of the intake section is portion below the horizontal plane. Thus, for example without limitation, if a cylindrical ESP assembly is arranged precisely horizontally in a well, the top portion of the intake section will be the trough on the upper half and the bottom portion of the intake section will be the trough on the lower half. An exemplary horizontal plane is illustrated in FIG. 4. In FIG. 4, horizontal plane 520 divides core 240 into top portion 530 and bottom portion 525.

One or more embodiments of the invention provide an apparatus, system and method for reducing gas intake in horizontal submersible pump assemblies. While the invention is described in terms of an oil or water production embodiment, nothing herein is intended to limit the invention to that embodiment.

The invention disclosed herein includes an apparatus, system and method for reducing gas intake in horizontal submersible pump applications. An ESP assembly system of illustrative embodiments may be placed about horizontally in a well containing gaseous fluid. Upon placement, gravity-actuated closing members of the apparatus may move to close and/or block the intake ports of the assembly that are on the top portion of the intake exposed to the gaseous portion of the well fluid. Intake ports that are at the bottom portion of the intake and exposed to the liquid portion of the well fluid may remain open since closing members may remain clear of those ports, such that the liquid may be pumped towards the surface of the well and the intake of gas is substantially reduced and/or avoided. Gravity may induce the closing members to move along tracks on a tapered (sloped) cylindrical core towards or away from the intake ports, causing intakes ports on the top of the intake section to close whilst leaving intake ports on the bottom of the intake section open.

The core of the apparatus is tapered and may be arranged such that its smaller side is on the downstream side of the core, where the intake ports are located. The closing members of the apparatus may be ball bearings that roll along a linear, sloped track on the tapered surface of the apparatus, thereby blocking an intake port only when an intake port is located at the lowest point along the track, as judged from the surface of the Earth. The closed intake ports at the top of the apparatus may reduce the intake of gas into the ESP assembly such that the risk of gas locking may be reduced and well production may be increased. Once the ESP assembly has been placed in a well and the radial orientation of the assembly about its longitudinal axis is thus determined, the closing members may actuate into place as dictated by gravity. The closing members may then remain in place during subsequent operation of the ESP assembly system so long as the radial orientation of the ESP assembly within the well is not modified.

Intake Section

Figure 5:
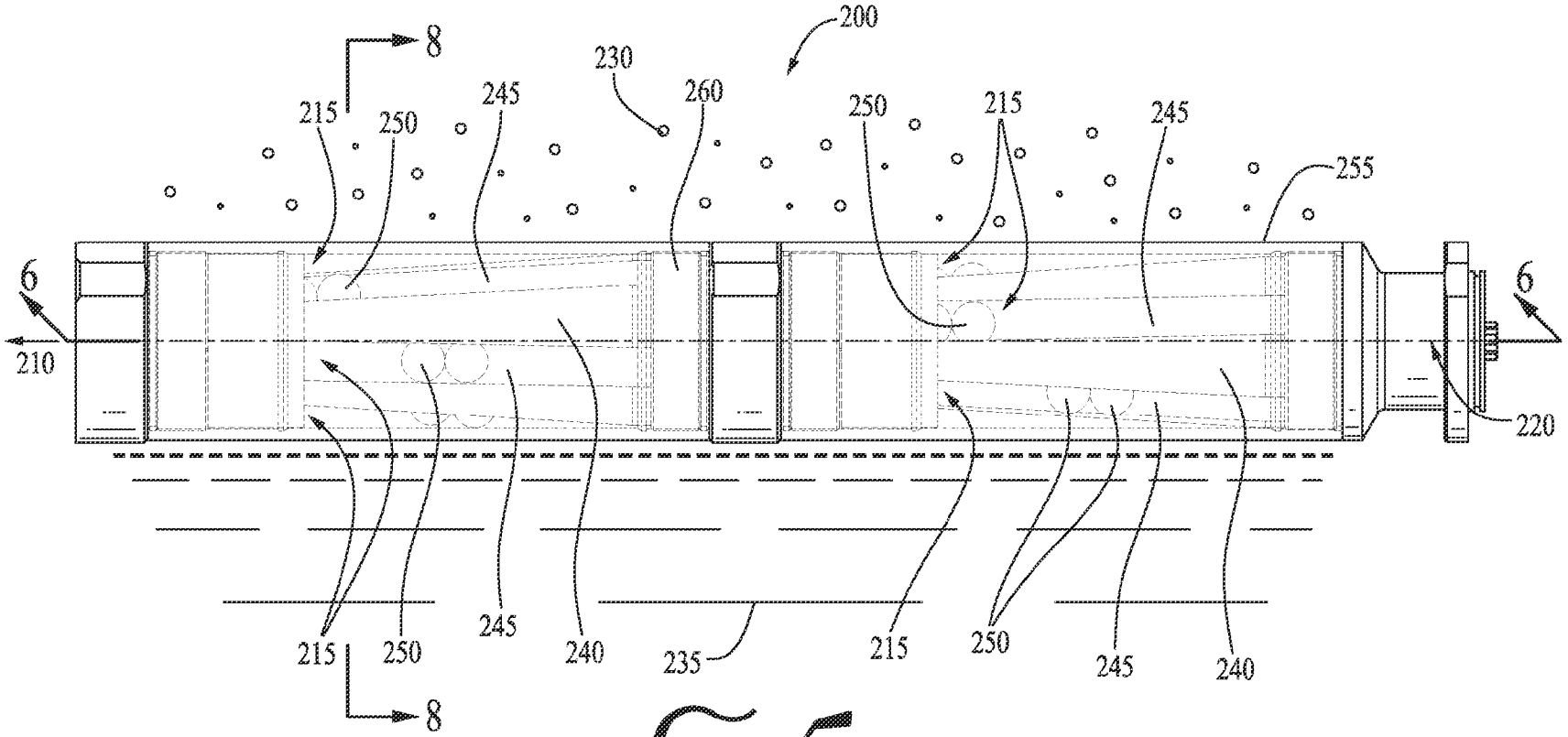
FIG. 5 is an elevation view of an intake section of an illustrative embodiment arranged horizontally in a well.
Figure 6:
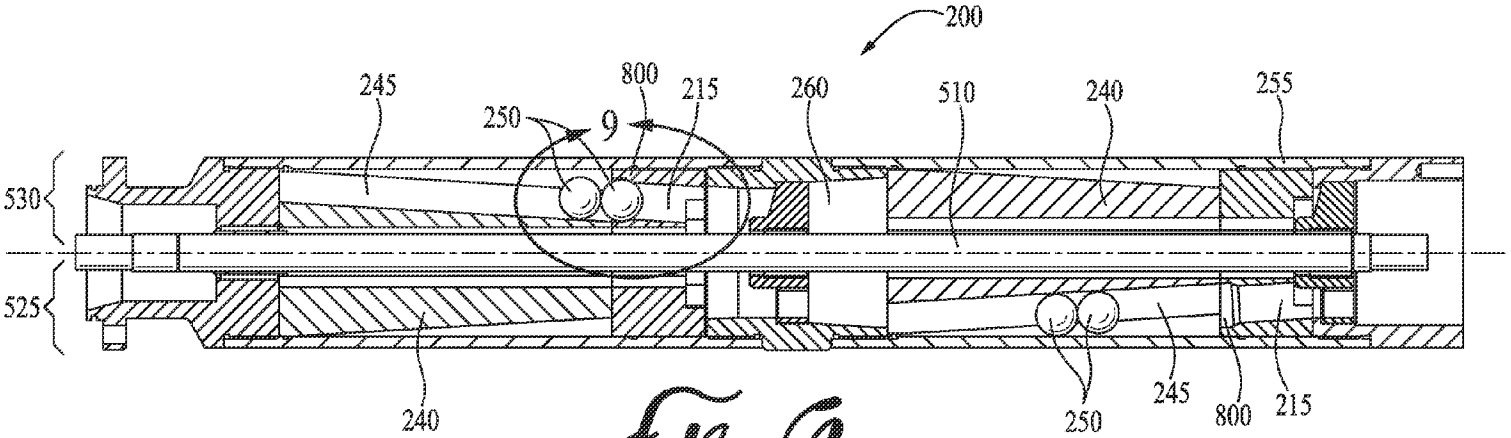
FIG. 6 is a cross sectional view take across line 6-6 of FIG. 5 of an illustrative embodiment of an intake section.

Illustrative embodiments include an intake section for electric submersible pump (ESP) assemblies. FIGS. 5 and 6 illustrate exemplary intake sections. As shown in FIG. 5, intake section 200 is arranged horizontally in a well. Intake section 200 may be an intake section of an ESP assembly located in an underground well, such as an oil or water well, with an ESP seal section and/or ESP electric motor upstream of intake section 200, and an ESP centrifugal pump and production tubing downstream of intake section 200. Intake section 200 may be the intake section of any centrifugal pump assembly employed in pumping gas-laden fluid, and may be used in place of, or in addition to, conventional intake sections. Intake section 200 may include one or more cores 240, which core 240 may be a tapered cylinder.

As shown in FIGS. 5 and 6, two core 240 may be employed in series in a single intake section 200, whereby a first core 240 is downstream of a second core 240. In some embodiments only a single core 240 may be necessary, or alternatively, three or more core 240 may be employed. In embodiments with two or more cores 240, cores 240 may be threaded to one another with guide 260, or otherwise connected together with splined shafts, bolting, clamping or adhesive.

Intake Core

As shown in FIGS. 5 and 6, intake section 200 may include tapered, cylindrical core 240. Core 240 may be carbon steel or any other material conventionally used for intake sections of ESP assemblies. As shown in FIGS. 4-6, core 240 has its smaller circumference, diameter and/or perimeter on a side where an intake port is located, which may also be the downstream side 500 of core 240. In some embodiments, such as when intake section 200 is located between the motor and pump of an ESP assembly, the diameter(s) of core 240 may be limited by the housing 255 and shaft 510 diameters of the ESP assembly. Core 240 may be arranged such that intake ports 215 are located circumferentially about core 240's smaller circumference or perimeter. In some embodiments, core 240 may be arranged in any manner such that when intake section 200 is arranged about horizontally, intake ports 215 disposed about core 240 may be closed when exposed substantially to gas and open when exposed substantially to liquid.

Track 245, which may be machined into, etched or attached (e.g., bolted, welded or glued) to core 240, allows closing member 250 to roll, move and/or slide towards or away from intake port 215, for example as dictated by gravity and/or as to minimize closing member 250's local potential energy (gravitational potential energy). Each track 245 may run lengthwise and linearly along outer surface 515 of core 240 and/or lead to an intake port 215. Where closing member 250 is gravity actuated, the gradient of track 245 and/or core 240 may impact the extent to which the orientation of intake section 200 may depart from horizontal while still allowing an intake port 215 to be blocked when exposed to gas.

Figure 7:
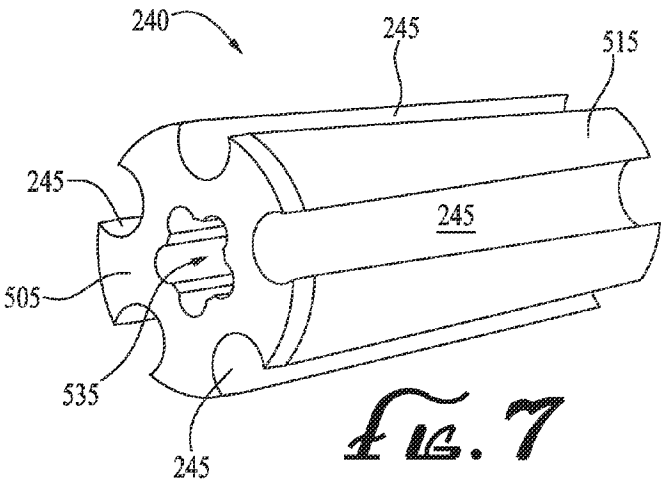
FIG. 7 is a perspective view of a tapered cylindrical core of an intake section of an illustrative embodiment.

FIGS. 4 and 7 illustrate a core 240 of illustrative embodiments. Core 240 may include central orifice 535 (shown in FIG. 7) to allow rotatable intake shaft 510 (shown in FIG. 4) and/or well fluid to run through its center, and tubular assembly housing 255 (shown in FIG. 5) encasing core 240. As shown in FIG. 4, core 240 may be arranged radially about shaft 510 and/or orifice 535, the smaller side of the taper being on the downstream side 500 of core 240 and/or intake section 200. In instances where no shaft 510 runs through the center of core 240, for example in embodiments where intake section 200 is upstream of an ESP motor, no shaft 510 may be present and orifice 535 may be omitted. The slope of outer surface 515 may be sloped downwards towards downstream side 500 on the top portion 530 of core 240, and sloped upwards towards downstream side 500 on the bottom portion 525 of core 240. Outer surface 515 may extend longitudinally between downstream side 500 and upstream side 505. The taper of outer surface 515 and/or core 240 may be limited by shaft 510 with respect to the smaller side of the taper, and housing 255 with respect to the larger side of the taper. The greater the taper (greater variance between the smaller and larger side of core 240), the greater the pump assembly's orientation in the ground may deviate from the horizontal whilst still allowing closing members 250 to close intake ports 215 on top portion 530 of core 240. In certain embodiments, the taper of outer surface 515 may be between 3 degrees and 20 degrees as measured from centerline 220 (shown in FIGS. 5 and 10).

Figure 8:
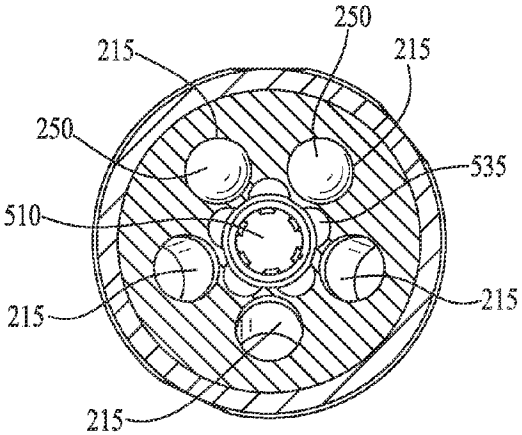
FIG. 8 is a cross sectional view taken along line 8-8 of FIG. 5 of an illustrative embodiment of an intake section.

Intake ports 215 may be located on outer surface 515 proximate to or on downstream side 500, and may be circumferentially dispersed about core 240, as illustrated by intake ports 215 shown in FIG. 8, each intake port having an associated track 245 (shown in FIGS. 5 and 6). Intake ports 215 may be evenly (uniformly) dispersed such that intake section 200 is symmetric radially about its longitudinal axis and thus indifferent to the radial orientation with which intake section 200 is ultimately placed into the well. Intake ports 215 may be apertures in outer surface 515 of core 240 through which well fluid flows to enter the ESP pump when intake port 215 is open. As shown in FIG. 8, of the five intake ports 215 arranged circumferentially about downstream side 500, the two inlet ports 215 on top portion 530 of core 240 are closed by closing members 250, whereas the three inlet ports 215 on bottom portion 525 of core 240 are open. In FIG. 8, closed intake ports 215 are entirely blocked from passage by well fluid since closing members 250 have plugged those intake ports 215.

Tracks and Closing Members

Returning to FIG. 4, tracks 245 may be on outer surface 515 and extend linearly along outer surface 515 between downstream side 500 and upstream side 505. Tracks 245 need not extend all the way to upstream side 505, and in some embodiments, may terminate at a midpoint along the length of outer surface 515. Tracks may be machined, etched, molded or attached onto outer surface 515. Each track 245 may terminate with, at and/or in proximity to an intake port 215 on the downstream side of core 240, the side of core 240 with the smaller taper. In this way an intake port 215 may be at least partially or entirely blocked (closed) when a closing member 250 is positioned in front of an intake port 215 as dictated by gravity, so as to block, seal and/or close the intake port 215 to avoid the intake of gas. When an intake port 215 is closed, well fluid may be prevented from passing through the closed intake port 215 due to the obstruction of closing member 250. In some embodiments, closing members 250 plug intake ports 215.

Tracks 245 may be sized and shaped such that closing members 250 are secured and will not fall away from outer surface 515, but held moveably in place to allow closing members 250 to roll, slide and/or actuate along the slope of outer surface 515. For example, tracks 245 may comprise an indentation and/or a railing. As shown in FIG. 7, tracks 245 may shaped to partially circumscribe closing member 250 and include a diameter slightly larger than closing members 250. In some embodiments, track 245 may extend at least partially around the circumference of closing members 250, for example about a third of the way or about halfway around the circumference of closing member 250. In some embodiments, closing member 250 may have a diameter of 1.125 inches and track 245 may have a diameter of 1.188 inches, if the circumference of track 245 were to be extrapolated to a full circle. Housing 255 (shown in FIG. 6) may also assist in keeping closing members 250 in place, for example by surrounding closing member 250 on the side of closing member 250 opposite track 245.

Figure 9:
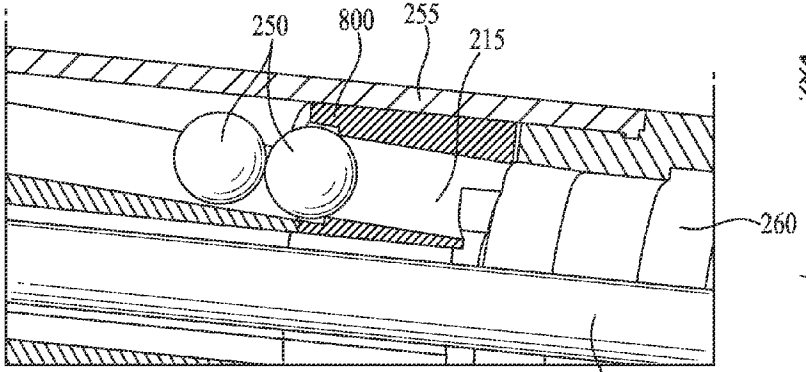
FIG. 9 is an enlarged cross section of an illustrative embodiment of a closed intake port.

Each track 245 may end on a downstream side 500 at seat 800. An exemplary embodiment of seat 800 is illustrated in FIG. 9. Seat 800 may be similar to a valve seat, acting to stop the movement of closing member 250 along track 245, and holding those closing members 250 blocking intake ports 215 in place during operation of the ESP assembly. A similar seat 800 or other obstruction, such as the walls of the tubing of a mercury switch, may be located on an upstream side 505 of track 245 to act as stop for closing members 250 actuating away from intake ports 215 on bottom portion 525 of core 240. As shown in FIG. 9, seat 800 may be positioned such that closing members 250 plug intake port 215 when resting on seat 800.

Closing Member Actuation

Closing members 250 may be moveably attached on each track 245 and may be one or more spherical ball bearings, mercury droplets, panels, flaps, and/or bars, that roll, slide and/or move along the length of track 245 as dictated by gravity. In some embodiments, closing member 250 may be a valve and mercury switch combination. In instances where a closing member 250 blocks an intake port 215, the intake port 215 should be at least partially blocked so as to reduce intake of gas into the ESP assembly by preventing well fluid from entering the closed intake port 215. Movement of closing members 250 may be dictated by gravity, such that a closing member 250 will settle at the lowest point along track 245 that is not otherwise obstructed by a seat 800.

As is well known to those of skill in the art, an object will naturally settle at a location having the lowest local potential energy, i.e. a "wheel" always rolls downhill. Thus, each closing member 250 will settle at the lowest point along its respective track 245, as judged from the surface of the Earth.

Figure 10:
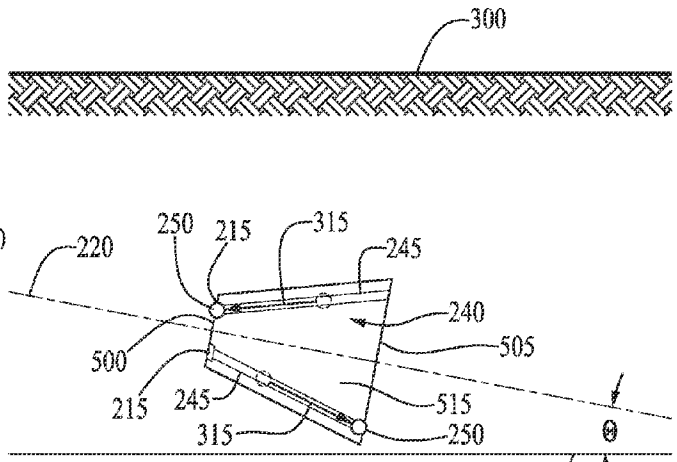
FIG. 10 is a diagram of a core of an intake section of an illustrative embodiment illustrating closing member actuation.

FIG. 10 illustrates gravity actuation of closing members 250. As shown in FIG. 10, core 240, which may be employed in an intake section 200 (not shown), is oriented underground at an angle θ from horizontal line 305, where horizontal line 305 is approximately parallel to Earth's surface 300. Centerline 220 runs longitudinally through the center of core 240 to form angel θ with horizontal line 305. As a result of the taper of core 240's outer surface 515, as well as the angle θ of core 240's pumping orientation, tracks 245 run at various angles from horizontal, depending upon track 245's radial location about outer surface 515.

Closing members 250 may be actuated by gravity, such that each closing member 250 may move to the point of lowest local potential energy along track 245 when core 240 and or intake section 200 is in any downhole orientation. As shown in FIG. 10, each closing member 250 has moved to about the lowest point along its respective track 245, depending on the location of track 245, seat 800 and/or intake port 215 about core 240. In FIG. 10, actuation lines 315 show the gravity induced actuation of closing members 250. Intake port 215 on the top portion 530 of core 240 are blocked by closing member 250 where gaseous layer 230 is present, and intake port 215 on the bottom portion 525 of core 240 are not blocked by closing member 250 where liquid layer 235 is present. In each case, closing member 250 has settled in a location at about the lowest point along its respective track 245 that is not obstructed by seat 800. In pumps arranged about horizontally, intake ports 215 on top portion 530 (shown in FIG. 4) of core 240, exposed to the layer of gas in the well, may remain closed and intake ports 215 on bottom portion 525 (shown in FIG. 4) of core 240, exposed to the liquid layer in the well may remain open. Thus, the apparatus of illustrative embodiments avoids and substantially reduces the intake of gas into the pump.

Closing Members During Operation of Pump Assembly

Closing member 250 may be moveably attached to track 245 and/or intake section 200 such that it may move in front of, towards or away from intake port 215, but will remain secured on core 240 during operation of the pump. Closing member 250 may be a single ball bearing or a plurality of ball bearings, such as one or more tungsten carbide balls each about 1.125 inches in diameter. In certain embodiments, closing member 250 may be multiple ball bearings to increase the weight of closing member 250. A heavier weight of closing member 250 may be desirable to counteract fluid flow dynamics during placement and/or operation of the ESP assembly of which the intake section 200 is a part. In embodiments where closing members 250 are exposed to well fluid, the weight of closing member 250 may be selected such that the flow of well fluid may not interfere with the gravity-actuated motion of closing members 250. In some embodiments, closing member 250 may be a bar or cylinder. In certain embodiments, closing member 250 may be a valve or flap that closes intake port 215, and/or track 245 may not be necessary. Closing member 250 may be any size necessary to at least partially block intake port 215 when intake port is exposed to gaseous layer 230 and/or when intake port is on top portion 530. In some embodiments closing member 250 entirely closes (blocks) an intake port 215 such that substantially no well fluid is able to bypass closing member 250 and pass through closed intake port 215.

Grease or lubricant may be applied to track 245 to assist in movement of closing member 250 and reduce friction, for example in edge cases with tracks of minimal slope. Lubrication of track 245 may assist in counteracting friction, but in any event, friction may not substantially effect the overall operation of illustrative embodiments in that the intake of gas into the pump of illustrative embodiments is materially reduced.

Core 240 may be shaped to include a sloped out surface, such as a cone or tapered cylinder, or be any shape which causes closing members 250 to block intake port 215 when gas is proximate intake port 215 and core 240 and/or intake section 200 is sufficiently horizontal (for example, within about 3.5 degrees or within about 15 degrees from horizontal, depending upon the specific dimensions of core 240). In some embodiments, greater variance from horizontal may be tolerated depending upon the shape, size and/or location of intake section 200 and/or core 240, and whether the shape and size of core 240 is limited by the housing or shaft of the ESP assembly. In some embodiments, intake port 215 may be arranged about core 240, such that each closed intake port 215 is located at about the lowest point along the gradient of core 240. Intake ports 215 may be circumferentially disposed about core 240. In some embodiments, core 240 includes five intake port 215 uniformly spaced about the circumference of core 240, with a track 245 running axially along core 240 and leading towards/away from each intake port 215. In certain embodiments two core 240, each core 240 with five intake ports 215 evenly spaced about downstream side 500 of core 240, are offset radially by 36 degrees. FIG. 6 illustrates two core 240 with tracks of each respective core 240 offset radially from one another. In some embodiments, the number and location of core 240, track 245, closing member 250 and intake port 215 are optimized to maximize the intake of liquid into the ESP assembly and/or minimize the intake of gas. The orientation of intake section 200 and/or the ESP assembly in a well (angle θ) may also be selected to optimize the efficient operation of closing member 250 and the intake of liquid rather than gas.

Gravity Actuated Circuit

Figure 11:
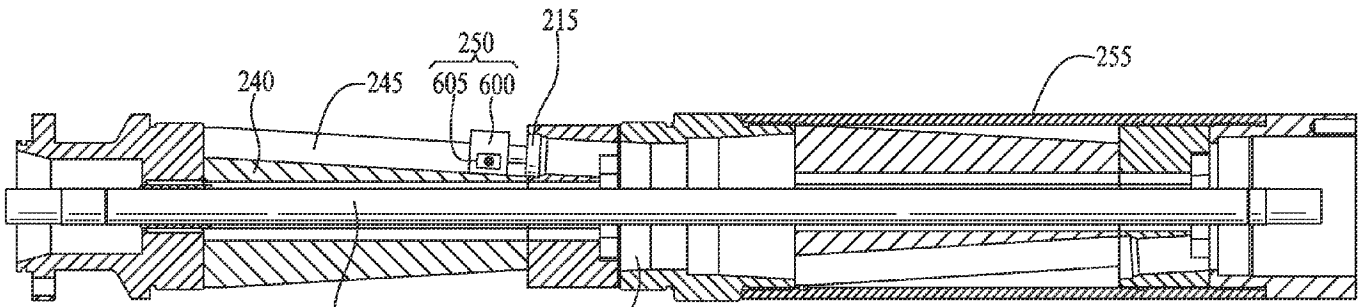
FIG. 11 is a cross sectional view of an intake section including a valve on an intake port of an illustrative embodiment.

In certain embodiments, closing member 250 may be actuated through the use of an electronic circuit, the circuit completed through actuation by gravity. For example, closing member 250 may be a valve, solenoid and/or mercury switch. FIG. 11 shows an intake port with a valve of an illustrative embodiment. In such embodiments, mercury switch 605 placed proximate an intake port 215 and/or valve 600 may detect whether an intake port 215 is on top portion 530, signaling valve 600 to close, or bottom portion 525, signaling valve 600 to open. Mercury switch 605 may "detect" the location of an intake port based on the slope of core 240 proximate each intake port 215, i.e., whether the slope of core 240 at a particular intake port 214 is upwards or downwards. Mercury switch 605 may comprise electrical wiring and a small droplet of mercury. As with embodiments using ball bearings, the droplet of mercury may roll or slide to the location of lowest potential energy within the tubing (track) containing the mercury. Valve 600 may operate through an electrical solenoid (not shown) that is activated through a signal only transmitted when the mercury switch is inclined such that the circuit is completed by the mercury droplet. In illustrative embodiments, valves 600 may be open or closed through the use of electricity supplied by the power cable for the ESP motor.

Figure 12:
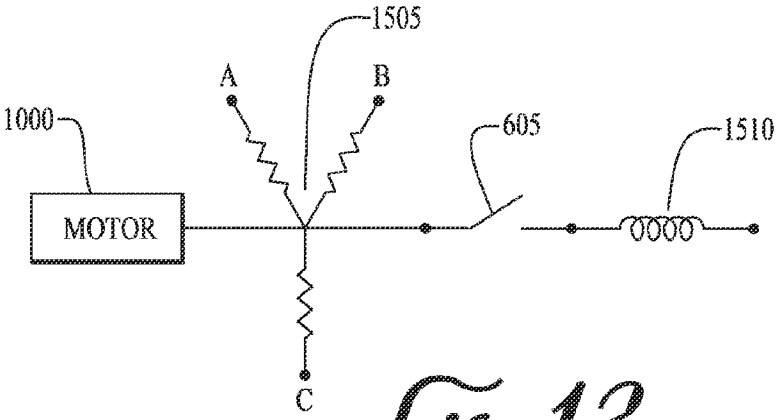
FIG. 12 is a diagram of an electrical closing member of an illustrative embodiment.

FIG. 12 is an illustrative embodiment of a circuit to open or close valve 600. As shown in FIG. 12, Y point 1505 may provide power from ESP motor 1000 to solenoid 1510, which solenoid actuates valve 600. When mercury switch 605 is closed, for example as the mercury droplet is guided by gravity to complete the circuit, power is provided to solenoid 1510 and valve 600 is closed. If the incline of outer surface 515 at a particular intake port 215 where the mercury switch 605 is located is such that the mercury droplet does not complete the circuit, valve 600 may remain open since power is not provided to solenoid 1510.

Alternatively, instructions sent from a variable speed drive (VSD) user interface may also be used to signal a valve to open or close. VSD's are well known to those of skill in the art and conventionally used to monitor and adjust the operation of an ESP in downhole wells, conventionally to turn the pump on or off or adjust the speed of the pump. In this case, the VSD may be programmed to control operation of valve 600. In some embodiments, a mercury switch may send a signal to the VSD when the switch is closed by gravity.

Intake Section Location

Figure 13:
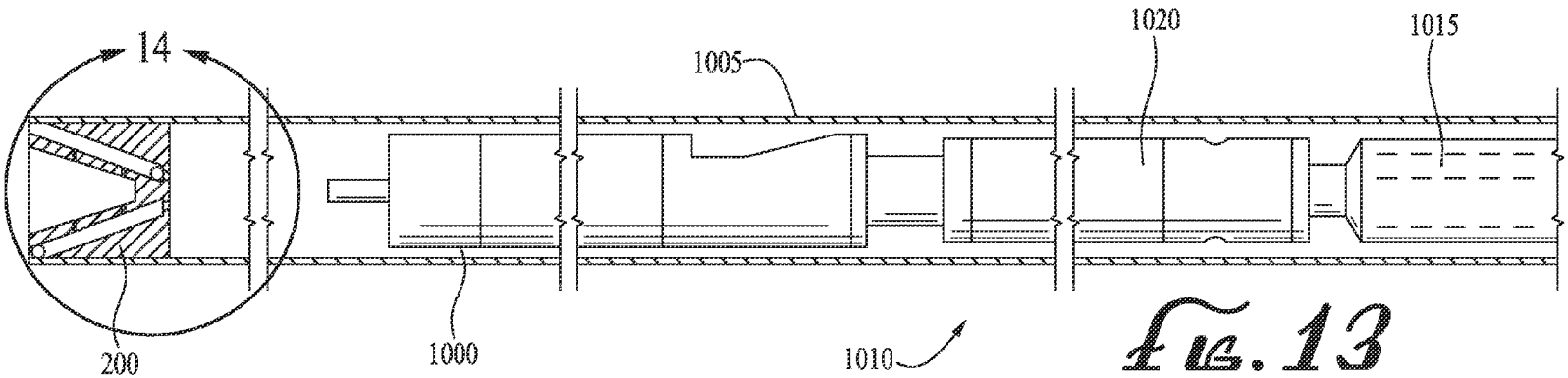
FIG. 13 is a cross sectional view of an ESP assembly having an intake section of an illustrative embodiment upstream of an ESP motor.

In conventional ESP assemblies, the intake section is located between the ESP motor and ESP pump. Perforations in the well casing may be located upstream of the motor, such that the well fluid flows past the outside of the motor prior to intake, cooling the motor. In some embodiments, instead of being located between the motor and pump of an ESP assembly, intake section 200 may be attached to the end of a motor jacket or sleeve of an assembly, upstream of the motor, as illustrated in FIG. 13. As shown in FIG. 13, intake section 200 is located upstream of ESP motor 1000. Shroud 1005 may enclose ESP assembly 1010 in order to induce well fluid to flow past motor 1000 prior to entering pump intake 1015. Seal section 1020 may be located between ESP motor 1000 and pump intake 1015. A centrifugal pump (not shown) is downstream of pump intake 1015. In such embodiments, gas may be excluded from well fluid by intake section 200 prior to the passage of fluid through the motor and seal section of an ESP assembly. Where intake section 200 is upstream of the motor 1000, the dimensions of core 240 may not be limited by the diameter of a shaft, since no shaft need extend through intake section 200, as illustrated in FIG. 13. Embodiments in which no shaft extends through intake section 200 may tolerate a greater variance from horizontal, for example at least 15 degrees or at least 20 degrees from horizontal, since the slope of outer surface 515 of core 240 may be greater than embodiments including a shaft 510 through intake section 200. This may be accomplished by providing for a smaller circumference on the downstream side of outer surface 515 then would otherwise be possible if it were necessary for core 240 to accommodate a shaft. In addition, this configuration may provide enhanced cooling of the motor assembly since gas in well fluid is a hindrance to cooling the motor with the fluid, and in the embodiment of FIG. 13, gas intake is reduced prior to the well fluid's passage by motor 1000.

Figure 14:
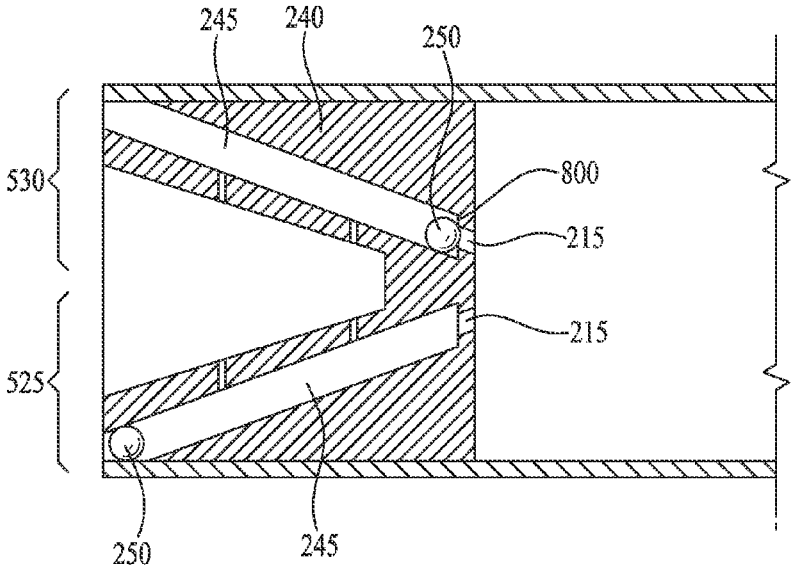
FIG. 14 is an enlarged cross section of a core with a shaft omitted of an illustrative embodiment.
Figure 15:
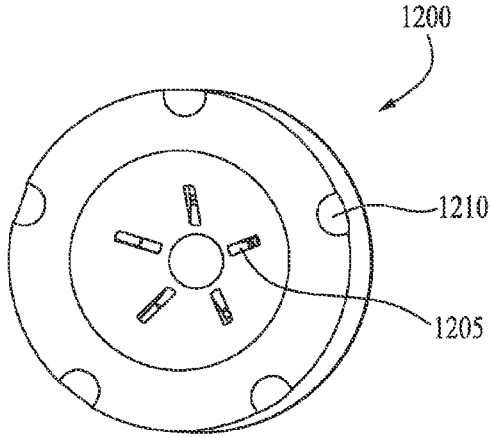
FIG. 15 is a perspective end view of an illustrative embodiment of an inlet side of an intake section.
Figure 16:
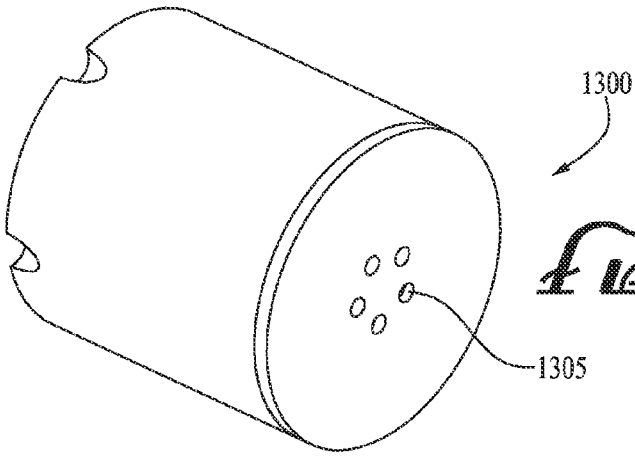
FIG. 16 is a perspective view of an illustrative embodiment of an exit side of an intake section.

FIG. 14 is an exemplary core 240 that does not contain a shaft 510. As illustrated in FIG. 14, the slope of tracks 245 may be increased due to the omission of shaft 510. As shown in FIG. 14, closing member 250 on top portion 530 blocks intake port 215 on top portion 530; closing member 250 on bottom portion 525 does not block intake port 215 on bottom portion 525. FIG. 15 is an illustrative embodiment of an inlet side 1200 of an intake section 200 to be placed at the end of a sleeve or motor jacket. Fluid enters the intake section 200 through inlet slots 1205 and inlet ports 1210 prior to passing through core 240. FIG. 16 is an illustrative embodiment of an outlet side 1300 of an intake section 200 to be placed at the end of a sleeve or motor jacket. Fluid exits intake section 200 through exits 1305 after passing through intake section 200. Due to closing members 250, the volume of gas in well fluid exiting intake section 200 may be reduced as compared to the volume of gas in well fluid entering intake section 200.

Vertical Applications

Figure 17:
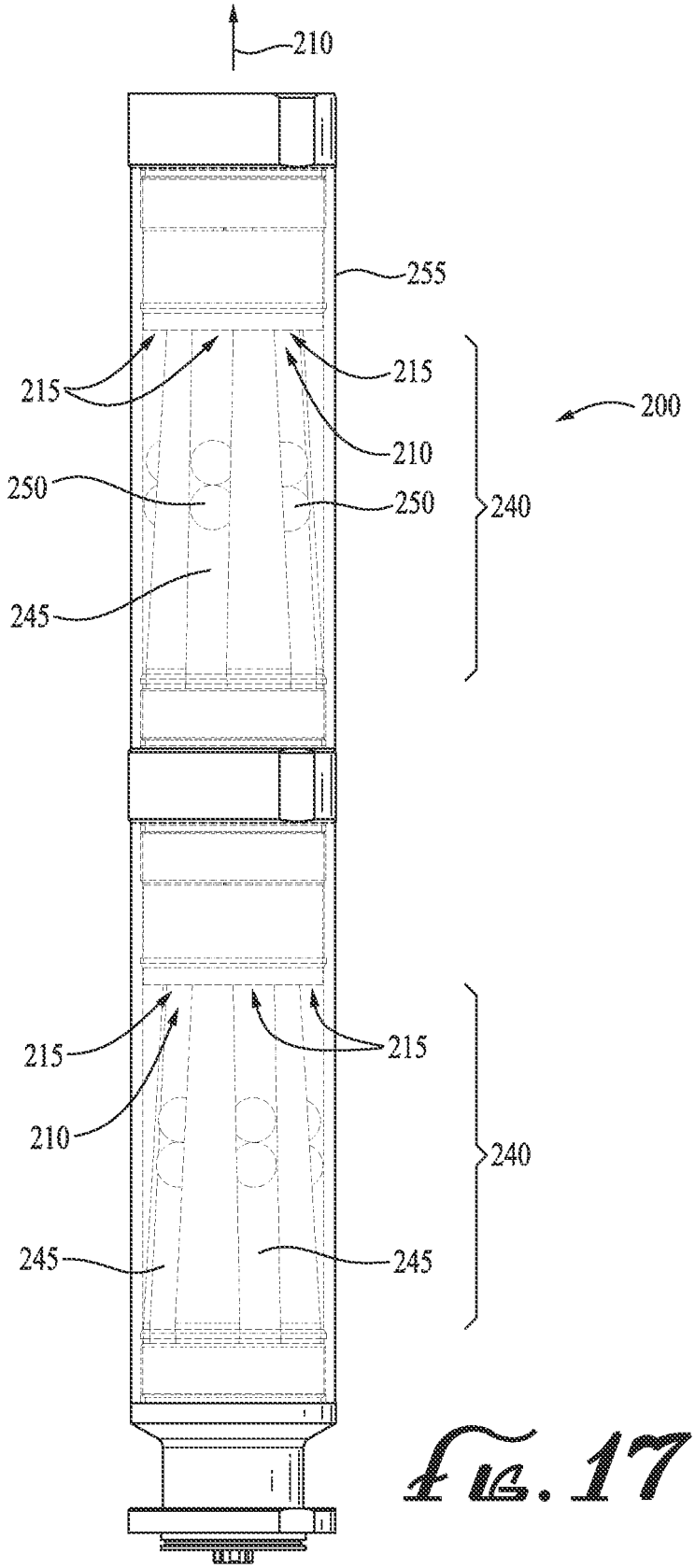
FIG. 17 is an elevation view of an intake section of an illustrative embodiment arranged vertically in a well.

The gas and liquid separation of well fluid experienced in horizontal well assemblies may not occur in vertical applications. If the ESP assembly of illustrative embodiments is arranged vertically in a well or, depending on the specific shape, length and/or working angle of the core, more than about 15 degrees or 20 degrees from horizontal, all of the intake ports may remain open since gravity may actuate the closing members away from all intake ports. In this way, the intake section of illustrative embodiments may be employed in both horizontal and vertical ESP applications. FIG. 17 is an illustrative embodiment of intake section 200 of an ESP assembly arranged vertically in a well. As shown in FIG. 17, well fluid is pumped upward in fluid flow direction 210. All intake ports 215 remain open, since gravity actuates closing members 250 away from all intake ports 215.

The intake section of illustrative embodiments may be suitable for a variety of types of submersible stages known in the art for use in electric submersible pumps. For example, mixed flow submersible pump stages, as well as radial flow submersible pump stages, may make use of the intake section of the invention. Both these and other submersible stages suitable for use with an ESP assembly may benefit from the apparatus, system and method for reducing gas intake of the invention.

As described herein, illustrative embodiments at least partially reduce the intake of gas into an ESP's centrifugal pump in downhole horizontal well applications. A core 240 of an intake section 200 may be tapered, such that a gravity-actuated closing member 250 may close intake ports 215 located on the top portion 530 of the intake section 200. The closed intake port 215 may assist in preventing the intake of gas from the well's upper gaseous layer into the centrifugal pump, when the assembly is arranged about horizontally in a well containing gaseous fluid. Intake ports 215 located on the bottom portion 525 remain open since gravity causes the closing members 250 on the bottom portion 525 to move away from the intake ports 215. When the ESP assembly is arranged vertically in a well, all intake ports 215 may remain open.

The intake section may be located between an ESP pump and an ESP motor or alternatively may be located upstream of the ESP motor to improve cooling of the motor and to allow for an increased slope of the intake section's core. In some embodiments, valves and a mercury switch may be implemented as or in addition to closing members 250, to close intake ports when the mercury switch completes a circuit. Illustrative embodiments of the invention allow an intake section to be implemented in either horizontal or vertical pumping applications. Illustrative embodiments of the invention reduce the intake of gas into an ESP pump without regard to the radial orientation of the pump when positioned in the well. Upon initial placement of the ESP assembly in a well, closing members may settle into position as dictated by gravity and remain in such position throughout operation of the ESP assembly. As described herein, the intake section of illustrative embodiments may reduce gas intake into a centrifugal pump of an ESP assembly, improving well efficiency and decreasing downtime of the ESP assembly.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. An intake section of an electric submersible pump (ESP) assembly, the ESP assembly comprising a centrifugal pump and an electric motor, the ESP assembly arranged about horizontally in a well comprising gas laden fluid, the intake section comprising:

a tapered cylindrical core, wherein a slope of the tapered core extending from an upstream side to a downstream side is downward at a top portion and upward at a bottom portion;

at least two tracks circumferentially dispersed about the tapered core, wherein the at least two tracks extend lengthwise between the upstream side and the downstream side of the tapered core, and wherein the downstream side of each of the at least two tracks comprises an intake port, wherein the intake ports are fluidly coupled to a centrifugal pump; and a closing member moveably attached within each of the at least two tracks such that a particular intake port located on the top portion of the tapered core is blocked by the moveable closing member, and a particular intake port located on the bottom portion of the tapered core is open.

2. The intake section of claim 1, wherein the particular intake port located on the top portion of the tapered core is exposed to a gas layer in a well.

3. The intake section of claim 1, wherein five closing members are moveably attached on five tracks circumferentially dispersed about the tapered core.

4. The intake section of claim 1, comprising two tapered cylindrical cores arranged in series.

5. The intake section of claim 1, wherein the intake section comprises a first and a second tapered core arranged in series, wherein the first and the second tapered cores each comprise five tracks evenly and circumferentially dispersed about the tapered core, and wherein the tracks of the first tapered core are offset radially by about 36 degrees from the tracks of the second tapered core.

6. The intake section of claim 1, wherein the closing member is a tungsten carbide ball bearing.

7. The intake section of claim 6, wherein the closing member comprises two tungsten carbide ball bearings.

8. The intake section of claim 1, wherein the intake section is located upstream of an electric motor of an ESP assembly.

9. The intake section of claim 1, wherein the intake section is located between an ESP seal section and an ESP pump.

10. The intake section of claim 1, wherein the closing member comprises a mercury switch.

11. The intake section of claim 10, wherein the closing member comprises a valve.

12. The intake section of claim 1, wherein the closing member is gravity actuated.

13. A horizontal electric submersible pump (ESP) system for pumping gaseous fluid comprising:

a multi-stage centrifugal pump;

an electric motor operatively coupled to the centrifugal pump; and an intake section upstream of the centrifugal pump comprising:

a tapered core further comprising:

a sloped outer surface extending between a downstream side and an upstream side of the tapered core;

a first intake port for the intake of well fluid in an ESP assembly, the first intake port located on a top portion of the tapered core and proximate to the downstream side;

a gravity-actuated closing member moveably attached on the sloped outer surface, wherein the gravity-actuated closing member closes the first intake port; and a second intake port located on a bottom portion of the tapered core, the second intake port open to the well fluid.

14. The ESP of claim 13, wherein each intake port further comprises a track extending along the sloped outer surface and terminating at the intake port.

15. The ESP of claim 14, wherein a first tapered core and a second tapered core are arranged longitudinally in series.

16. The ESP of claim 15, wherein each of the two tapered cores comprise five tracks evenly and circumferentially dispersed about the sloped outer surface, and wherein the tracks of the first tapered core are offset radially by about 36 degrees from the tracks of the second tapered core.

17. The ESP of claim 15, wherein the first tapered core is directly downstream of the second tapered core, and wherein the track of the first tapered core is offset radially from the track of the second tapered core.

18. The ESP of claim 13, wherein the closing member comprises two tungsten carbide ball bearings each about 1.125 inches in diameter.

19. The ESP of claim 13, wherein the closing member comprises a mercury switch and a valve.

* * * * *